United States Patent [19]

Williams

[11] 4,234,115

[45] Nov. 18, 1980

[54] WATCH BAND ASSEMBLY

[76] Inventor: Bill D. Williams, 702 Marion Dr., Madison, Ala. 35758

[21] Appl. No.: 42,437

[22] Filed: May 25, 1979

[51] Int. Cl.[3] ..... A44C 5/00

[52] U.S. Cl. ..... 224/168; 224/179

[58] Field of Search ..... 224/168, 164, 175, 177, 224/179, 180

[56] References Cited

U.S. PATENT DOCUMENTS

| | | | |
|---|---|---|---|
| 1,806,439 | 5/1931 | Barton | 224/179 |
| 1,818,637 | 8/1931 | Mathez | 224/179 X |
| 2,521,375 | 9/1950 | Johnston | 224/168 |
| 2,619,270 | 11/1952 | Foster | 224/168 |
| 3,677,449 | 7/1972 | Williams | 224/179 |
| 4,069,953 | 1/1978 | Vetter | 224/179 X |

*Primary Examiner*—Steven M. Pollard

*Attorney, Agent, or Firm*—Watson, Cole, Grindle & Watson

[57] ABSTRACT

A resilient watch band which includes identical latching mechanisms at both ends that can be attached to a watch body without removing the pins attached thereto. Each latching mechanism includes a clasp element which has a U-shaped head portion that extends beyond the end of the watch band, the clasp element being slidable along a longitudinal groove in the end of the watch band to allow the head portion to extend to a variable distance away from the end of the watch band; two cooperable release buttons which are connected by a spring and function to allow the clasp element to be either fixed or moved along the longitudinal groove; and a cover element which covers a major portion of the other elements and which includes an extension flange that can cooperate with the head portion of the clasp element to lock a pin member therewithin when the head portion is fixed at its closest distance from the end of the watch band.

5 Claims, 8 Drawing Figures

WATCH BAND ASSEMBLY

THE INVENTION

This invention relates to a new and improved resilient watch band.

In the same way that molded plastics have replaced metals in the construction of eye glass frames because in most cases, they have proven to be more acceptable for skin contact, molded plastics will undoubtedly gradually in replace metals in the manufacture of watch bands.

The present watch band provides a most convenient method for connecting or disconnecting one end of such a watch band from a watch without removing the watch pin from the watch.

Since both ends of the inventive watch band are identical, the inventive watch band can be completely attached or detached from the watch in a most convenient manner and without the need for removing any pins from watch.

Contouring of the watch band to accommodate different size wrists may be accomplished during or after their manufacture, and in fact by sales personnel at time of sale.

The features of the present invention will be best understood from a review of the following description taken in conjunction with the attached drawings.

DETAILED DESCRIPTION OF THE PREFERRED EMBODIMENT

Figure 1:
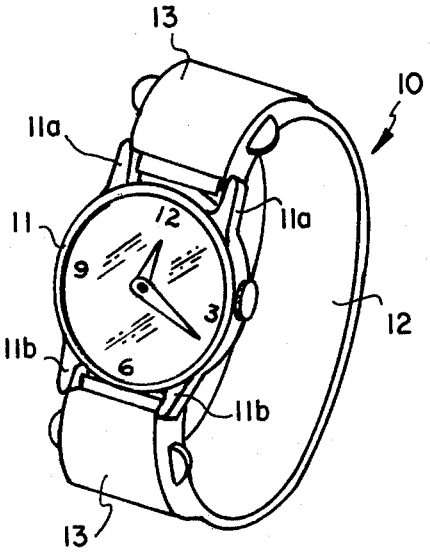
FIG. 1 shows a perspective view of a wristwatch which includes a standard watch body and a wrist band constructed in accordance with the present invention.

As can be seen from a review of FIG. 1, a wristwatch generally labeled 10, includes a watch body 11 and a resilient watch band 12, the watch band 12 being constructed in accordance with the present invention. The watch body 11 includes two pairs of spaced apart extension flanges 11*a* and 11*b* located on opposite sides of the watch body and which support therebetween separate pin elements (see pin element 11*c* shown in FIG. 3) in a conventional fashion. The inventive watch band 12 includes identical latching mechanisms 13 at opposite ends thereof.

Figure 2:
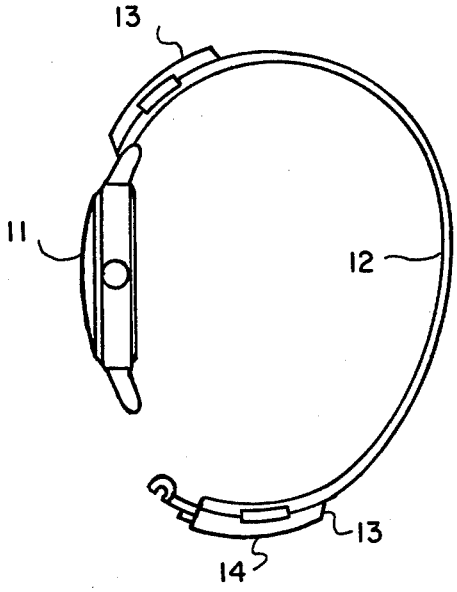
FIG. 2 depicts a side view of the wristwatch of FIG. 1 but wherein the latching mechanism at one end of the wrist band has been detached from the watch body.
Figure 3:
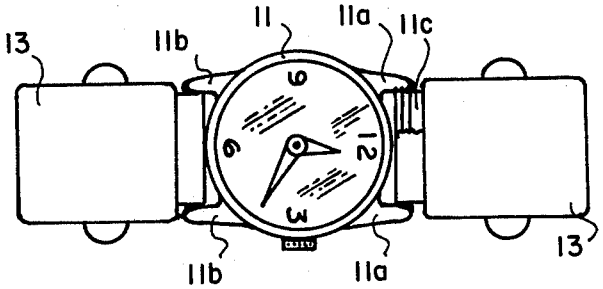
FIG. 3 shows a partially broken away plan view of the wristwatch in FIG. 1 and shows the mechanism of attachment between the latching mechanism at one end of the watch band with the watch body.

Referring to FIGS. 2 and 3, each of the latching mechanisms at the ends of the watch band 12 include internal structural elements, at least one of the elements being positionable to extend to a first distance beyond the end of the watch band so as to partially wrap around a pin element attached between opposed extension flanges of the watch body (FIG. 2), and then be repositioned to a second and shorter distance beyond the end of the watch band (see FIG. 3). In addition, each latching mechanism includes cover elements (see cover element 14 in FIG. 2) which can enclose a major portion of the internal structural elements of the associated latching mechanism.

Figure 4:
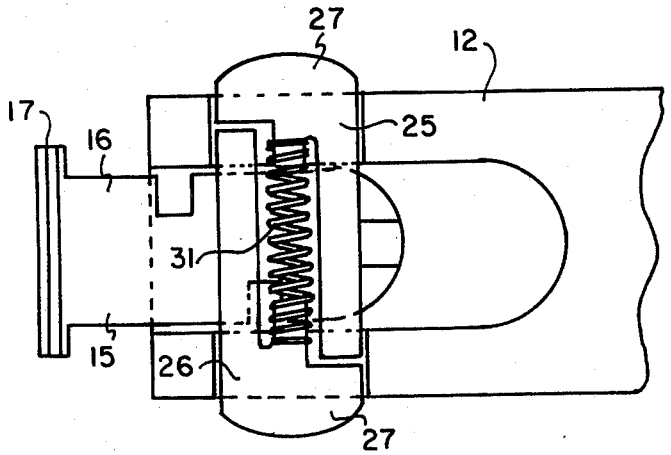
FIG. 4 shows on an enlarged scale one end of the watch band of FIG. 1 and schematically depicts the elements within the associated latching mechanism.
Figure 5:
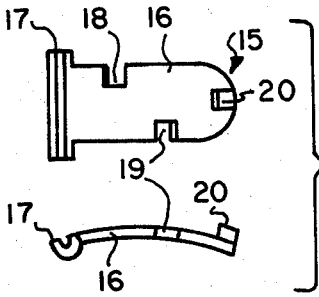
FIG. 5 shows on a reduced scale two views of the clasp element which is part of the structure of the latching mechanism of FIG. 4.
Figure 6:
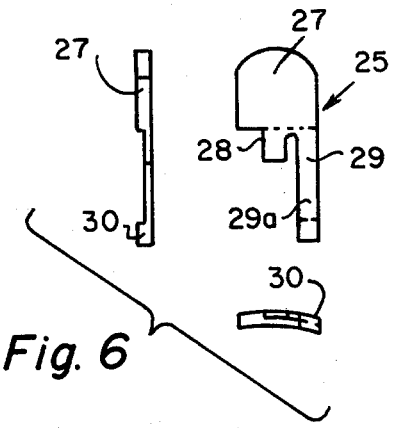
FIG. 6 shows on a similar scale to FIG. 5 three views of one release button which is part of the structure of the latching mechanism of FIG. 4.
Figure 7:
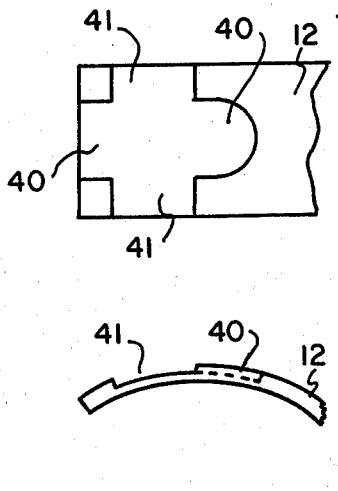
FIG. 7 shows on a similar scale to FIG. 5 two views of the configuration of the end of the watch band shown in FIG. 4.

As shown in FIG. 4, each latching mechanism includes a clasp element 15, two opposed release buttons 25 and 26, and a coiled spring 31. The clasp element 15, which is best seen in FIG. 5, comprises a curved elongated body portion 16, an enlarged U-shaped head 17 connected to one end of the body portion 16, two slots 18, 19 on opposite sides of the body portion 16, and a knob 20 connected to the other end of the body position 16, the knob 20 projecting away from the body portion top surface 16*a*. The clasp element 15 slidably fits within a groove 40 which is formed (e.g., molded or milled) in the end of the watch band (see FIG. 7) to extend along the longitudinal dimension thereof.

Each of the two release buttons 25 and 26 includes a curved head portion 27 and two extension portions 28 and 29 which have smaller thicknesses than the curved head portion 27. Extension portion 29 is longer than extension portion 28, and it includes a knob 30 that projects away from the surface 29*a* thereof. The knobs 30 on each release button are shaped to fit within the slots 18 and 19 on the opposite sides of the body portion 16 of the clasp element 15. As seen in FIG. 4, two release buttons are positioned in cooperating fashion such that the coiled spring 30 fixedly interconnects the two extension portions 28. The spring 30 acts to return the release buttons to their original positioning (such that the tips of their curved head portions extend laterally beyond the sides of the watch band) after being manually pressed so as to slide together along the transverse groove 41 formed in the end of the watch band.

Figure 8:
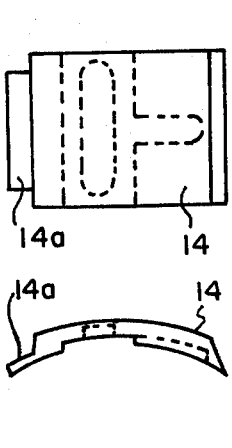
FIG. 8 shows on a similar scale to FIG. 5 two schematic views of the cover element that is capable of covering a major portion of the other elements of the latching mechanism shown in FIG. 4.

The cover element 14, as shown in FIG. 8, is attachable to the end of the watch band 12 shown in FIG. 4 so as to enclose element 31 and a major portion of the elements 15, 25 and 26. In addition, the cover element 14 includes an extension flange 14*a* which extends beyond the end of the watch band 12 and is capable of preventing a pin member (such as pin member 11*c* of FIG. 3) from escaping out of the opening in the U-shaped head 17 of the clasp element 15 when the clasp element 15 is positioned fully within groove 40 in the respective end of the watch band 12 and the head 17 is located at its shortest distance from the end of the watch band.

In operation, and when it is desired to latch the end of the watch band 12 to a pin member attached between two opposed flanges of a watch body, the head portions of the release buttons 25 and 26 (which extend laterally beyond the sides of the watch band—see FIGS. 1, 3 and 4) are pushed together against the bias of spring 30 such that the respective knobs 30 attached to ends of the extension portions move laterally out of engagement within respective slots 18 and 19 in the body portion 16 of the clasp element 15, and the clasp element 15 can be moved along groove 40 in the end of the watch band 12 such that the U-shaped head 17 of the clasp element 45 is at its furthest (first) distance from the end of the watch band 12 (the knob 20 on the body portion 16 will prevent the clasp element from being removed entirely from the latching mechanism by abutment against the release button 25—see FIG. 4). At this time the pin member can be positioned within the U-shaped head portion of the clasp element 15. Then the clasp element can be pushed back into the latching mechanism and along groove 40 in the end of the watch band 12 until the respective knobs 30 on the release buttons 25 and 26 fit within respective slots 18 and 19 in the body portion 16 of the clasp element 15. The clasp element will then be fully positioned within groove 40 and its head 17 positioned at its closest (second) distance from the end of the watch band 12. At this location the extension flange 14*a* of the cover 14 will block off the opening in the U-shaped head portion of clasp element 15 such that the pin member will be locked therein. The end of the watch band will then be lockingly connected to the watch body, and without the need of removing the associated pin member from its positioning between the spaced apart extension flanges attached to the watch body.

The same procedure can be used to attach the opposite end of the watch band to the other pin member connected to the watch body. At the same time, the procedure can be reversed so as to disengage the ends of the watch band from the watch body.

While this invention has been illustrated by a single watch band assembly, it is to be appreciated that the scope of this invention is that of the inventive concept of the invention as set forth in the appended claim.

I claim:

1. A resilient watch band, the ends of which can be attached or detached from a respective pin member attached to a watch body without removing the pin member from attachment to the watch body, the watch band including identical latching mechanisms at each end thereof, each latching mechanism including a clasp element having an elongated body portion and a head portion, the head portion being capable of wrapping around a watch body pin member and the body portion of the clasp element being slidable within a longitudinal groove in the end of the watch band so as to allow its head portion to be positioned at a varying distance from the end of the watch band; at least one release button which is capable of either locking the position of said clasp element such that said head portion is at its closest distance from the end of the watch band or when pressed can allow the clasp member to be manually moved along said groove such that the head portion will be at its furthest distance from the end of the watch band; and a cover element which is capable of covering most of said clasp element and each release button, said cover element including an extension flange which extends sufficiently beyond the end of said watch band to lock a pin member in said clasp element head portion when said clasp element is positioned within said groove that its head portion is at its closest distance to the end of said watch band.

2. The resilient watch band of claim 1 wherein each latching mechanism includes two opposed release buttons which have curved head portions which extend laterally beyond the sides of said watch band, and wherein a spring means connects said release buttons together.

3. The resilient watch band of claim 2 wherein said release buttons are slidable along a transverse groove in said watch band.

4. The resilient watch band of claim 2 wherein the head portion of each clasp element is U-shaped, and wherein the body portion of each clasp element includes slots formed in the sides thereof.

5. The resilient watch band of claim 4 wherein each said release button includes two extension portions connected to said curved head portion, one extension portion being longer than the other, the longer extension portion including a knob attached thereto which is capable of fitting within a slot on the side of the body portion of a clasp element, and wherein said spring means comprises a coiled spring connected between the shorter extension portions of two said release buttons.

* * * * *